US005949961A

United States Patent [19]

Sharman

[11] Patent Number: 5,949,961

[45] Date of Patent: Sep. 7, 1999

[54] WORD SYLLABIFICATION IN SPEECH SYNTHESIS SYSTEM

[75] Inventor: Richard A. Sharman, Southampton, United Kingdom

[73] Assignee: International Business Machines Corporation, Armonk, N.Y.

[21] Appl. No.: 08/503,960

[22] Filed: Jul. 19, 1995

[51] Int. Cl.[6] ..... G10L 5/02

[52] U.S. Cl. ..... 395/2.69; 395/2.67; 395/2.72

[58] Field of Search ..... 395/2.6–2.66, 395/2.51, 759, 760, 2.69, 2.67, 2.72

[56] References Cited

PUBLICATIONS

K. P. H. Sullivan and R. I. Damper (1992) "Novel-Word Pronunciation Within a Text-to-Speech System", *Talking Machines: Theories, Models, and Designs*, pp. 183–195.

*Primary Examiner*—Allen R. MacDonald
*Assistant Examiner*—Alphonso A. Collins
*Attorney, Agent, or Firm*—Quarles & Brady

[57] ABSTRACT

The present invention relates to a system and method of word syllabification. The present invention receives a word to be syllabified and determines therefrom all possible substrings capable of forming part of the word. Sequences matching at least part of or the whole of the word are determined from the substrings together with respective probabilities of occurrence and the sequence having the greatest probability of occurrence is selected as being the most probable syllabification of the word. The most probable sequence can be determined in many different ways. For example, the sequence can be determined by commencing with the substring having the greatest probability of forming the beginning of a given word and subsequently traversing in a step-by-step manner a table comprising all possible substrings of the word and at each step selecting the next substring of the sequence according to which of the possible next substrings has the highest probability of occurrence. A further method of determining the most probable sequence would be to adopt the above step-by-step approach for all possible substrings capable of forming the beginning of the given word. Alternatively, all possible sequences of substring capable of constituting the word can be determined together respective probabilities of occurrence thereof and the sequence having the highest respective probability of occurrence is selected as being the most probable syllabification of the given word.

15 Claims, 5 Drawing Sheets higer figure = probability of path lower figure = transition probability

Best solution :-

+ te + le + phone + #

| | 1 | 2 | 3 | 4 | 5 | 6 | 7 | 8 | 9 | 10 | 11 |
|---|---|---|---|---|---|---|---|---|---|---|---|
| 11 | 0 | | | | | | | | | | |
| 10 | 0 | 0 // | | | | | | | | | |
| 9 | 0 | 0 telephone | 0 # | | | | | | | | |
| 8 | 0 | 0 telephon | 0 elephone | 0 # | | | | | | | |
| 7 | 0 | 0 telepho | 0 elephon | 0 lephone | # | | | | | | |
| 6 | 0 | 0 teleph | 0 elepho | 0 lephon | ephone | # | | | | | |
| 5 | 0 | 0 telep | 0 eleph | 0 lepho | ephon | 0·024 ← 0·4 phone | 0 0120 ← 0·5 # | | | | |
| 4 | 0 | 0 tele | 0 elep | 0 leph | epho | phon | hone | # | | | |
| 3 | 0 | ·1 ·1 tel | 0 ele | ·04 ·2 lep | 0·4 eph | 0·012 ← 0·2 pho | hon | one | # | | |
| 2 | 0 | ·2 ·2 te | 0 el | ·06 ·3 le | ep | 0 ph | ho | on | 0·0036 ← 0·3 ne | # | |
| 1 | 1 (1) | 0 t | 0 e | 0 l | 0 e | 0 p | h | o | n | e | # |
| | # | t | e | l | e | p | h | o | n | e | # |

third pass second pass computers $P(S_2/S_1)$ $P(S_1/\#)$ first pass computers $P(S_1/\#)$ values set by initialisation, $P(\#)=1$

FIG 4

Transition Probabilities (example)

second syllable $S_2$

| first syllable $S_1$ | // | te | tel | le | eph | pho | ne | phone | hone | lep |
|---|---|---|---|---|---|---|---|---|---|---|
| # | 0 | ·2 | ·1 | ·1 | 0 | ·1 | ·1 | ·3 | 0 | ·1 |
| te | 0 | 0 | 0 | ·3 | 0 | ·2 | ·1 | 0 | ·2 | ·2 |
| tel | 0 | 0 | 0 | ·1 | ·4 | ·1 | ·1 | ·1 | ·1 | ·1 |
| le | 0 | ·1 | ·1 | 0 | 0 | 2 | ·1 | ·4 | ·1 | 0 |
| eph | ·1 | 0 | ·1 | ·1 | 0 | 0 | ·2 | 0 | 0 | ·5 |
| pho | 0 | ·1 | ·2 | ·1 | ·1 | 0 | ·3 | ·1 | 0 | ·1 |
| ne | ·3 | ·2 | ·1 | ·1 | 0 | ·1 | 0 | ·1 | ·1 | ·1 |
| phone | ·5 | ·1 | 0 | 0 | 0 | 0 | 0 | 0 | 0 | ·4 |
| hone | ·2 | ·1 | ·2 | ·1 | 0 | 0 | ·1 | 0 | 0 | ·3 |
| lep | ·1 | ·1 | ·2 | 0 | 0 | 0 | ·2 | 0 | ·4 | 0 |

FIG. 5

WORD SYLLABIFICATION IN SPEECH SYNTHESIS SYSTEM

BACKGROUND OF THE INVENTION

The present invention relates to word syllabification, typically for use in a text to speech system for converting input text into an output acoustic signal imitating natural speech.

Text-To-Speech (TTS) systems (also called speech synthesis systems), permitting automatic synthesis of speech from a text are well known in the art; a TTS receives an input of generic text (e.g. from a memory or typed in at a keyboard), composed of words and other symbols such as digits and abbreviations, along with punctuation marks, and generates a speech waveform based on such text. A fundamental component of a TTS system, essential to natural-sounding intonation, is the module specifying prosodic information related to the speech synthesis, such as intensity, duration and fundamental frequency or pitch (i.e. the acoustic aspects of intonation).

A conventional TTS system can be broken down into two main units; a linguistic processor and a synthesis unit. The linguistic processor takes the input text and derives from it a sequence of segments, based generally on dictionary entries for the words and a set of appropriate rules. The synthesis unit then converts the sequence of segments into acoustic parameters, and eventually audio output, again on the basis of stored information. Information about many aspects of TTS systems can be found in "Talking Machines: Theories, Models and Designs", ed G Bailly and C Benoit, North Holland (Elsevier), 1992.

The transcription of orthographic words into phonetic symbols is one of the principal steps carried out by text-to-speech systems. Conventionally, a TTS would look up words to be syllabified in a dictionary to determined the syllabification thereof. However, as language is constantly evolving, new words often do not have a corresponding entry in the dictionary. Therefore syllabification using a dictionary look up technique cannot be used for such new words.

A further problem with many conventional text-to-speech systems is that although the pronunciation of similar combinations of letters or syllables varies according to their context conventional systems do not take account of such variations. For example, in ascertaining the pronunciation of the word "loophole", only in light of knowledge of the pronunciation of the word "telephone", the consonant cluster "ph" might be pronounced "F". However, if the pronunciation of the word "loophole" were determined only in light of the known pronunciation of "tophat", the consonant cluster might be pronounced as "P" "H". The determining factor as to how clusters of letters are pronounced is dependent upon where the syllable boundaries are within a word. Possible syllable structures for the word "loophole" might be "loop"+"hole", or alternatively "loo"+"pho"+"le", or maybe "looph"+"o"+"le".

The syllable boundaries in a given observed word often, but not always, coincide with the morphological boundaries of the constituent parts of each word. However, so as not to confuse the question of the derivation of a word from its roots, prefixes and suffixes, with the question of the pronunciation of the word in small discrete sections of vowels and consonants, the term morphology is not used here. Strictly speaking the term syllable might be more accurately applied only after transcription to phonemes. However, it is used here to apply to pronunciation units described orthographically. Having identified the most probable sequence of syllables constituting the word "telephone" the information so identified is passed to the phonetic transcription stage to enable better judgements to be made in relation to the pronunciation thereof and in particular to the pronunciation of consonant and vowel clusters.

Hand-written rule sets can be determined, defining the transcription of a letter in context to a corresponding sound. These essentially view the transcription process as one of parsing with a context-sensitive grammar.

Further, some approaches have used additional information such as prefixes and suffixes and parts-of-speech to assist in resolving cases of ambiguous pronunciation. When the phonetic transcription problem is bounded, as is the case for the transcription of proper names, prior art techniques can be employed to improve accuracy of the transcription. The prior art techniques may include, for example, detecting the language of origin of the name and using different spelling-to-sound rules.

Each of the above methods have respective advantages and disadvantages in terms of computational speed, complexity and cost. However, the above prior art methods do not always accurately transcribe new words, neologisms, jargon or other words not previously encountered.

SUMMARY OF THE INVENTION

Accordingly, the present invention provides a method for automatic word syllabification comprising the steps of generating all possible substrings constituting part of the word and assigning each possible substring a respective probability, determining, from the possible substrings and respective probabilities, the sequence of substrings which represents the most probable syllabification of the word.

The probability assigned to each respective substring may relate to one of the following: its simple probability of occurrence or, for example, the bi-gram model of it occurrence i.e the probability of occurrence of the substring given a particular preceding substring (which is extensible to an n-gram model). The probability model utilized is governed by what is deemed to be an acceptable computational overhead.

The most probable sequence can be determined in many different ways. For example, the sequence can be determined by commencing with the substring having the greatest probability of forming the beginning of a given word and subsequently traversing in a step-by-step manner a table comprising all possible substrings of the word and at each step selecting the next substring of the sequence according to which of the possible next substrings gives the highest probability. A further method of determining the most probable sequence would be to adopt the above step-by-step approach for all possible substrings capable of forming the beginning of the given word. Alternatively, all possible sequences of substring capable of constituting the word can be determined together with respective probabilities and the sequence having the highest respective probability is selected as being the most probable syllabification of the given word.

BRIEF DESCRIPTION OF THE DRAWINGS

FIG. 4 illustrates a table comprising all possible substrings of the word "telephone".

FIG. 5 shows a look-up table comprising all substrings which are deemed to be known and relevant to the word telephone together with a value representing probability of a first substring being followed by a particular second substring.

DESCRIPTION OF THE PREFERRED EMBODIMENTS

Figure 1:
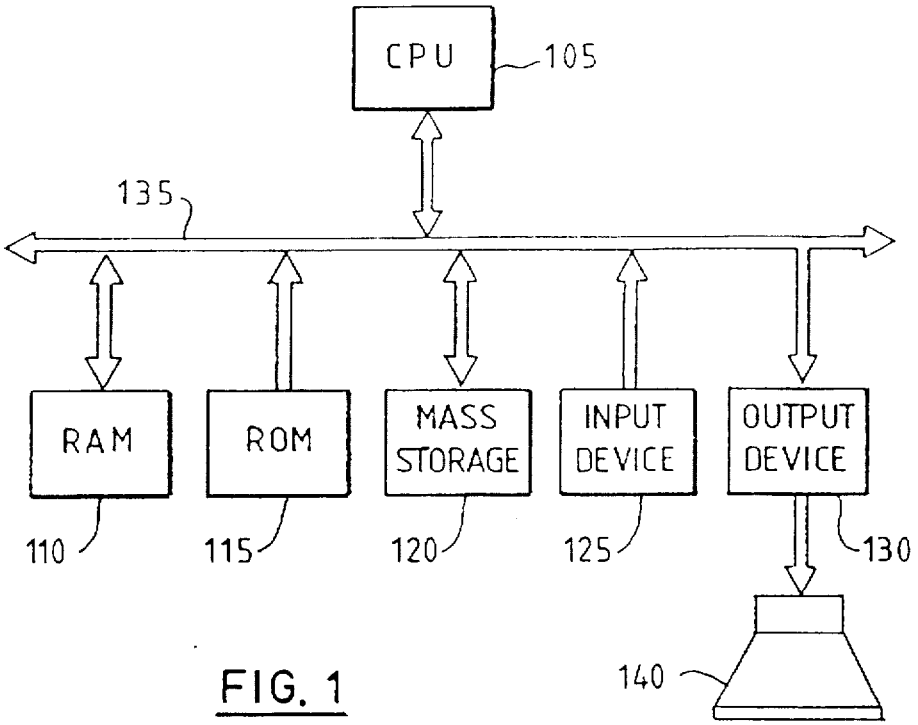
FIG. 1 is a simplified block diagram of a data processing system which may be used to implement the present invention.

FIG. 1 depicts a data processing system which may be utilized to implement the present invention, including a central processing unit (CPU) 105, a random access memory (RAM) 110, a read only memory (ROM) 115, a mass storage device 120 such as a hard disk, an input device 125 and an output device 130, all interconnected by a bus architecture 135. The text to be synthesized is input by the mass storage device or by the input device, typically a keyboard, and turned into audio output at the output device, typically a loud speaker 140 (note that the data processing system will generally include other parts such as a mouse and display system, not shown in FIG. 1, which are not relevant to the present invention). The mass storage 120 also comprises a data base of known syllables together with the probability of occurrence of the syllable. An example of a data processing system which may be used to implement the present invention is a RISC System/6000 equipped with a Multimedia Audio Capture and Playback Adapter (M-ACPA) card, both available from International Business Machines Corporation, although many other hardware systems would also be suitable.

Figure 2:
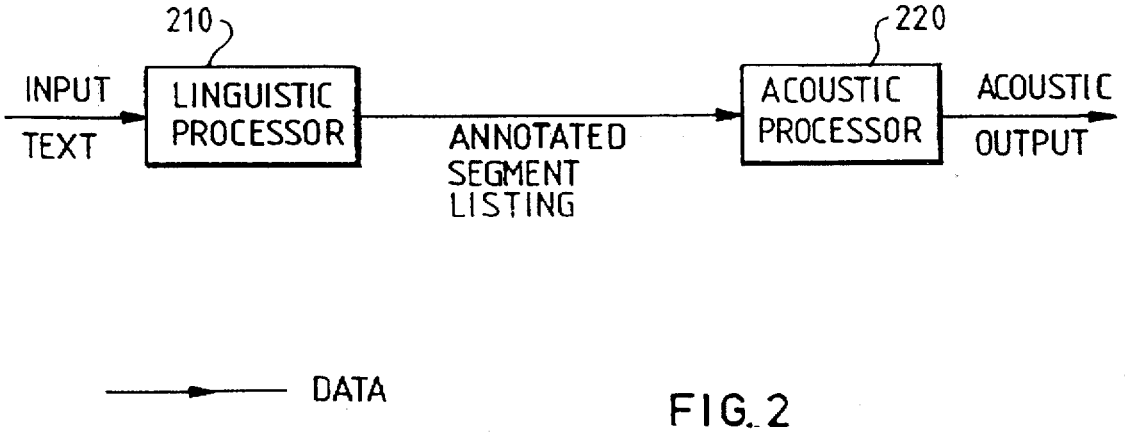
FIG. 2 is a high level block diagram of a text to speech system.

FIG. 2 is a high-level block diagram of the components and command flow of the text to speech system. As in the prior art, the two main components are the linguistic processor 210 and the acoustic processor 220. These perform essentially the same task as in the prior art, ie the linguistic processor receives input text, and converts it into a sequence of annotated text segments. This sequence is then presented to the acoustic processor, which converts the annotated text segments into output sounds. In the current embodiment, the sequence of annotated text segments comprises a listing of phonemes (sometimes called phones) plus pitch and duration values. However other speech segments (eg syllables or diphones) could easily be used, together with other information (eg volume).

Figure 3:
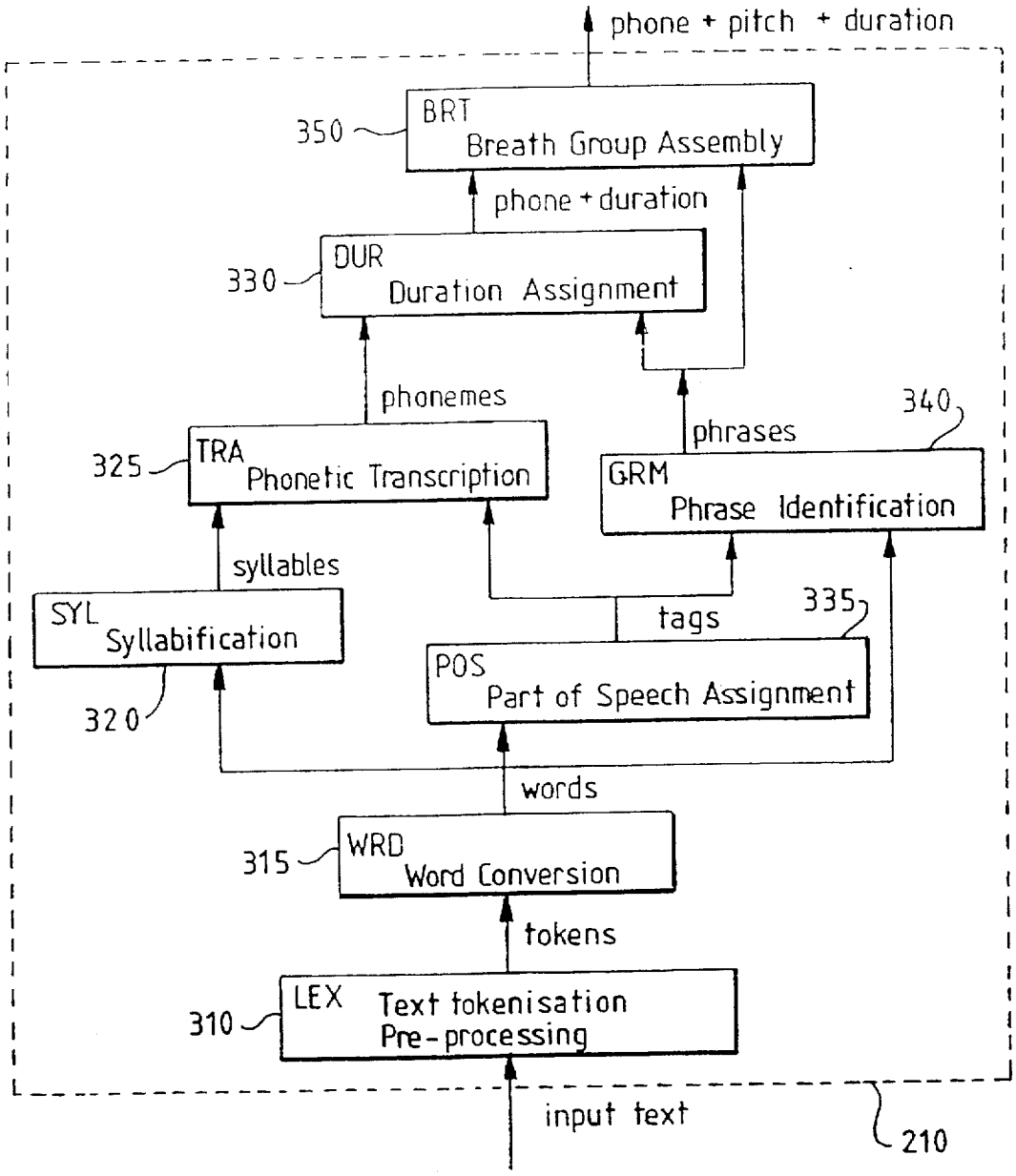
FIG. 3 is a diagram showing the components of the linguistic processor of FIG. 2.

FIG. 3 illustrates the structure of the linguistic processor 210 itself, together with the data flow internal to the linguistic processor. It should be appreciated that most of this structure is well-known to those working in the art; the difference from known systems lies in the way that the syllabification process is effected. As the structure and operation of an acoustic processor is well known to those skilled in the art it will not be discussed further.

The first component 310 of the linguistic processor (LEX) performs text tokenisation and pre-processing. The function of this component is to obtain input from a source, such as the keyboard or a stored file, performing the required input/output operations, and to split the input text into tokens (words), based on spacing, punctuation, and so on. The size of input can be arranged as desired; it may represent a fixed number of characters, a complete word, a complete sentence or line of text (ie until the next full stop or return character respectively), or any other appropriate segment. The next component 315 (WRD) is responsible for word conversion. A set of ad hoc rules are implemented to map lexical items into canonical word forms. Thus for examples numbers are converted into word strings, and acronyms and abbreviations are expanded. The output of this state is a stream of words which represent the dictation form of the input text, that is, what would have to be spoken to a secretary to ensure that the text could be correctly written down. This needs to include some indication of the presence of punctuation.

The processing then splits into two branches, essentially one concerned with individual words, the other with larger grammatical effects (prosody). Discussing the former branch first, this includes a component 320 (SYL) which is responsible for breaking words down into their constituent syllables. The next component 325 (TRA) then performs phonetic transcription, in which the syllabified word is broken down still further into its constituent phonemes, for example, using a dictionary look-up table. There is a link to a component 335 (POS) on the prosody branch, which is described below, since grammatical information can sometimes be used to resolve phonetic ambiguities (eg the pronunciation of "present" changes according to whether it is a vowel or a noun).

The output of TRA is a sequence of phonemes representing the speech to be produced, which is passed to the duration assignment component 330 (DUR). This sequence of phonemes is eventually passed from the linguistic processor to the acoustic processor, along with annotations describing the pitch and durations of the phonemes. These annotations are developed by the components of the linguistic processor as follows. Firstly the component 335 (POS) attempts to assign each word a part of speech. There are various ways of doing this: one common way in the prior art is simply to examine the word in a dictionary. Often further information is required, and this can be provided by rules which may be determined on either a grammatical or statistical basis; eg as regards the latter, the word "the" is usually followed by a noun or an adjective. As stated above, the part of speech assignment can be supplied to the phonetic transcription component (TRA).

The next component 340 (GRM) in the prosodic branch determines phrase boundaries, based on the part of speech assignments for a series of words; eg conjunctions often lie at phrase boundaries. The phrase identifications can use also use punctuation information, such as the location of commas and full stops, obtained from the word conversion component WRD. The phrase identifications are then passed to the breath group assembly unit BRT as described in more detail below, and the duration assignment component 330 (DUR). The duration assignment component combines the phrase information with the sequence of phonemes supplied by the phonetic transcription TRA to determine an estimated duration for each phoneme in the output sequence. Typically the durations are determined by assigning each phoneme a standard duration, which is then modified in accordance with certain rules, eg the identity of neighboring phonemes, or position within a phrase (phonemes at the end of phrases tend to be lengthened). A Hidden Markov Model (HMM) is an alternative method that can be used to predict segment durations.

The final component 350 (BRT) in the linguistic processor is the breath group assembly, which assembles sequences of phonemes representing a breath group. A breath group essentially corresponds to a phrase as identified by the GRM phase identification component. Each phoneme in the breath group is allocated a pitch, based on a pitch contour for the breath group phrase. This permits the linguistic processor to output to the acoustic processor the annotated lists of phonemes plus pitch and duration, each list representing one breath group.

The operation of the syllabification component 320 will now be discussed in more detail. The syllabification component receives a word to be syllabified from the word component 315. Firstly, a dictionary, in the form of, for example, an on-line data base, may be examined to determine if there is an entry corresponding to the given word together with the syllabification thereof. If so, then the syllabification of the word is retrieved from the dictionary and output in the conventional manner. If not, the present invention determines the most probable syllabification of the given word.

A word, W, having a number of letters, n, contains n(n+1)/2 substrings comprising contiguous letters, any of which may potentially be syllables. The substrings can be conveniently represented using a triangular table, $T_n=\{t_{i,j}\}$, as shown in FIG. 4. The first step in parsing the word is to generate all the possible substrings which might constitute part of the word.

The working of the present invention will be illustrated by considering the syllabification of the word "telephone" and assuming that the dictionary does not contain an entry for that word. The above table containing all possible substrings of the word "telephone" is shown in FIG. 4. The first column represents the word boundary, "#". Each substring, $s_i$, in the second column of the table also contains a number representing the probability of occurrence of that substring given a word boundary, $P(s_i,\#)$. Such probabilities are derived from a look-up table as shown in FIG. 5. For example, the probability that substring "te" is succeeded by substring "le" is $P(s_2,s_1)=P(le,te)=0.3$. Such look-up table can be derived from an appropriate statistical analysis of a dictionary comprising the syllabification of the entries therein. The probability values derived from the dictionary can comprise a mono-gram model in which each value thereof is calculated by determining the total number of occurrences of each type of syllable and dividing the total numbers by the total number of syllables. Alternatively, each probability value can be derived from a bi-gram model in which each value thereof is determined by calculating the total number of occurrences of contiguous pairs of syllables of a particular type. The values in the table of FIG. 5 have been normalized to sum to one across each row.

Although the table illustrated in FIG. 5 provides the probability of occurrence of substring $S_2$ given a preceding substring $s_1$ the present invention is not limited thereto. An embodiment can equally well be realized in which the table entries of FIG. 5 represent tri-gram probabilities. Such a tri-gram model would then be three-dimensional and require three indices to access each value. That is, the probability of occurrence of substring $S_3$ given the preceding substrings $S_2S_1$ i.e $P(s_3|s_2,s_1)$. Alternatively, the table may comprise values which are representative of the probability of occurrence of a substring i.e $P(s_1)$. Such a table would then be one-dimensional and would require a single index to access the values contained therein.

Referring back to FIG. 4, probability values for the remaining positions of the table are determined as follows. The substring having the highest probability of following a word boundary is determined to be the most probable starting syllable of the word. For example, assume the current substring, $s_1$, representing the most probable starting substring, is "te". For each possible contiguous substring, $s_2$, a corresponding probability value, $P(S_2,S_1)$, is determined from the look-up table. That is the probability of the "te" being succeeded by each of the substrings, "T", "le", "lep", . . . , "lephon", and "lephone" contained in the fourth column of the table, is determined from the look-up table and stored in the appropriate position in the table. Therefore, for example, table position (4,2), representing the probability of substring "te" being succeeded by substring "le", will contain the probability $P(s_2,s_1)=P(le,te)=0.3$ determined from the look-up table. A probability value is determined for all entry positions in the fourth column of the table of FIG. 4 resulting in the following list of probabilities P(l,te), P(le,te), P(lep,te), P(leph,te), . . . , and P(lephone,te).

Each of the probabilities P(l,te), P(le,te), P(lep,te), P(leph,te), . . . , and P(lephone,te) are used to determine a respective path probability. A path comprises a sequence of sub-strings capable of representing at least part of the given word, W. Each path probability is the product of the probabilities of the substrings constituting the sequence thus far. The path having the highest probability is selected to be the most likely syllabification of the given word thus far. For example, the path probability for the sequence "#"+"te"+"le" is given by $P(s_2,s_1).P(s_1,\#).P(\#)=p(le,te).P(te,\#)=0.3\times 0.2\times 1=0.06$. The sequence "#"+"te"+"le" has the highest path probability and is selected as the most likely syllabification of the word so far. Therefore, the syllabification of the word "telephone" starts with syllables "te" and "le". As the path probability is determined in an incremental manner by considering the next possible contiguous substrings and the previous path probability remains constant, effectively the next contiguous substring selected to form part of the path is that substring having the highest associated probability.

Having identified "le" as being the most likely substring to follow "te", the substring most likely to follow "le" is determined in a manner similar to that out-lined above. That is, probability values are determined for each of the possible contiguous substrings in the sixth column of the table. Accordingly, the following probabilities are determined: P(p,le), P(ph,le), P(pho,le), . . . , P(phon,le), and P(phone,le). The maximum of the respective path probabilities is again selected as being the most likely syllabification of the word so far. From the table it can be seen that the highest path probability is given by $P(s_3,s_2).P(s_2,s_1).P(s_1,\#).P(\#)=P(phone,le).P(le,te).P(te,\#).P(\#)=0.4\times 0.3\times 0.2\times 1=0.024$. Therefore, the next substring in the sequence is "phone" and the most probable sequence of substrings representing the word "telephone" is "te"+"le"+"phone".

Figure 6:
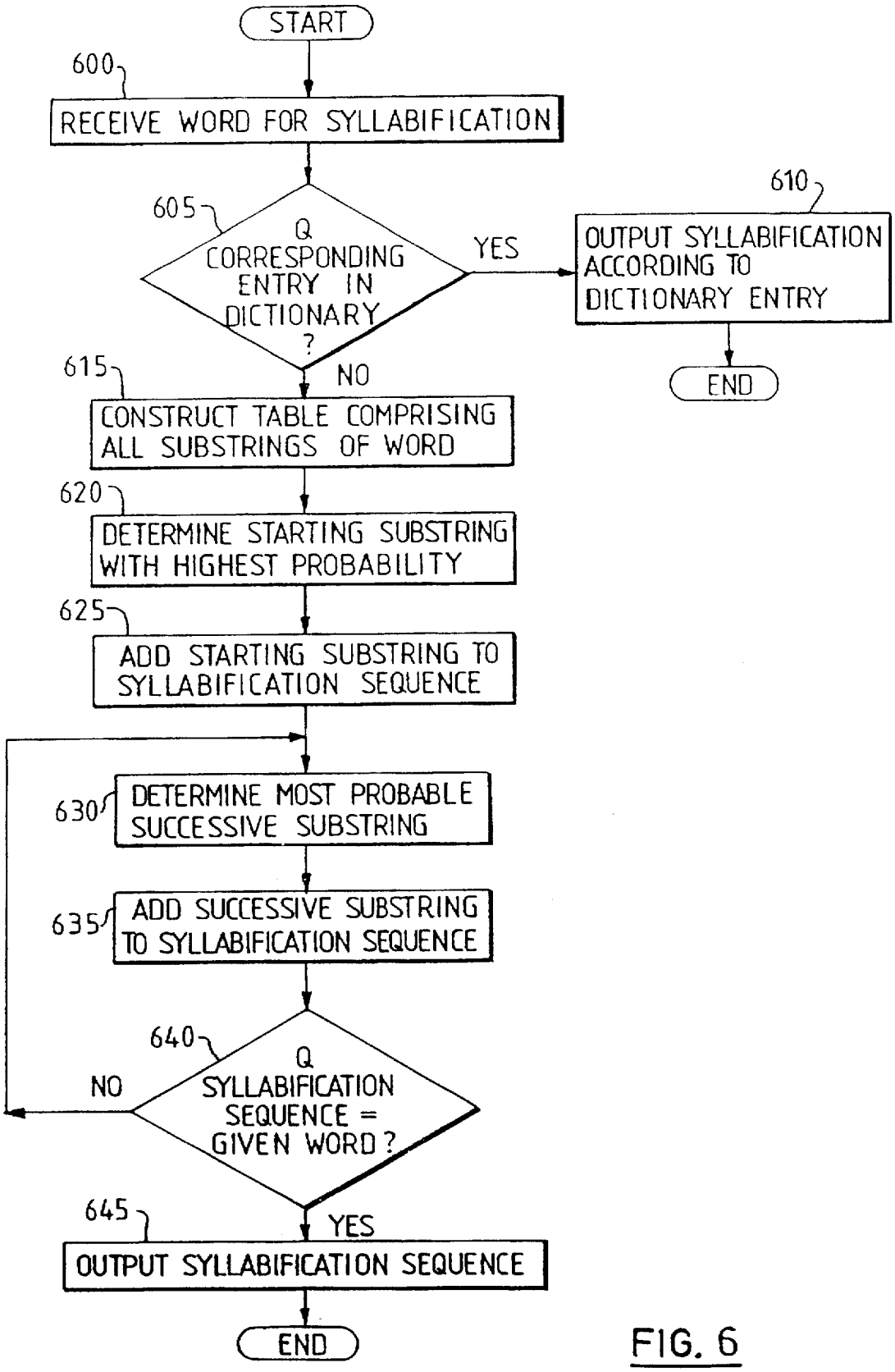
FIG. 6 is a flow diagram illustrating the steps of word syllabification.

Referring to FIG. 6 there is shown a flow diagram illustrating the steps of word syllabification. At step 600 a word for syllabification is received from the word conversion component 315. Step 605 determines whether or not the word has a corresponding entry in the dictionary. If so, the syllabification of the word is derived from the dictionary and output for further processing at step 610. If not, a table is constructed comprising all substrings of the word at step 615. Step 620 determines from the look-up table which of the substrings, $s_i$, has the highest probabilities of occurrence given a word boundary, $P(s_i,\#)$. The substring, $s_i$, having the highest probability is added to the syllabification sequence (SYLL_SEQ) at step 625. Step 630 determines which of the possible contiguous substrings is likely to follow the current substring by calculating for each a path probability. The substring identified by step 630 is added to the syllabification sequence at step 635. Step 640 determines whether or not the syllabification sequence is equal to the given word. If so, the syllabification process is complete and the syllabification sequence, SYLL_SEQ, represents the most likely syllabification of the word, W. The sequence is output for further processing at step 645. If not, the syllabification process continues at step 630.

Further ways of calculating the most probable syllabification of a word are described in the embodiments below.

A second embodiment of the present invention can be realized in which a plurality of possible syllabification sequences are determined. Each possible syllabification sequence beginning with one of the possible starting syllables. Therefore, rather than, at step 620 of FIG. 6, processing only the substring with the highest probability of occurrence given a word boundary and determining a syllabification sequence therefrom, a syllabification sequence is determined for each possible starting substring and the most probable of each of the possible syllabification sequences is then determined.

The syllabification of a given word for each of the possible starting substrings is determined in a manner as described above. Each syllabification sequence so determined is recorded together with respective path probabilities for later comparison with all other determined path probabilities. The path probability represents the product of each of the probabilities associated with each substring in the path. The syllabification sequence having the highest path probability is selected to represent the syllabification of the given word. For example, two such sequences are "te"+"le"+"phone" and "tel"+"eph"+"one" having respective path probabilities of, for example, 0.024 and 0.0036. Accordingly, "te"+"le"+"phone" would be selected as being the most probable syllabification of the word "telephone" in preference to the sequence "tel"+"eph"+"one".

A third embodiment determines all possible sequences of substrings capable of constituting the given word and calculates for each sequence an associated probability value. The substring having the highest associated probability is selected as being the most probable syllabification of the given word. This embodiment can be expressed algorithmically as follows.

Let
s=the number of syllables, and A|1 . . . s;1 . . . s| be a table of transition probabilities,
m=length of word to be syllabified,
n=m+2,
T|1 . . . n;1 . . . n| and T'|1 . . . n,1 . . . n| be a two dimensional array of floating point numbers,
T|i;j|=0 for all i=1 . . . n and all j=1 . . . n,
T|1;1|=1, to indicate the initial starting point,
U|1 . . . n;1 . . . n| be a two-dimensional array of possible syllables or substrings for a given word,
for each column, c, where c=1 . . . n do
  for each row, r, where r=1 . . . n−c+1 do
    for each row, v, where v=1 . . . n−v+1 do
      new_path_prob=T|r;c|×A|U|r;c|;U|v;c+r||
      if new_path_prob>T|v;c+r|
      then set T|v;c+r|=new_path_prob and
        set T'|v;c+r|=(r;c) a back path
To recover the most probable path,
start at T|r;c| where r=1 and c=m,
while (r<>1 and c<>1) do
  previous item is at T'|r;c| put this value in (r;c)

Again, the probabilities may represent simple probabilities of occurrence or more complex n-gram probabilities derived from an n-dimensional table such as the bi-gram probabilities illustrated in FIG. 5. There are well known methods of reducing the computational intensity of the above algorithm.

A theoretical motivation for the above word syllabification is to consider a word to be an encoded form of syllables. The syllabification results from decoding the given word.

An orthographic word, W, is defined as a sequence of letters, $w_1, w_2, \ldots, w_n$. A syllabic word, S, is defined as a sequence of syllables, $s_1, S_2, \ldots, s_m$. The observed letter sequence, W, can then arise from a hidden sequence of syllables, S, with conditional probability P(W|S). There are a finite number of such syllable sequences, of which the one given by max P(W|S), taken over all possible syllable sequences, is the maximum likelihood solution. That is, the syllable sequence, S, represents the most probable syllabification of the word, W.

By the well-known Bayes theorem, the expression P(W|S) can be written as:

$$\max_s [P(W \mid S)] = \max_s \left[ \frac{P(S \mid W)P(S)}{P(W)} \right].$$

In this equation P(S|W) represents a probability distribution capturing the facts of syllable division, while the P(S) is a different distribution capturing the facts of syllable sequences. The latter model thus contains information such as which syllables form prefixes and suffixes, while the former captures some of the facts of word construction in the usage of the language. Note that the term P(W), which models the sequence of letters, is not required in the maximization process, since it is not a function of S. Given the existence of these two distributions there is a well-understood method of estimating the parameters of a hidden Markov Model (HMM) which approximates the true distributions, and performing the decoding as disclosed in "Tutorial on Hidden Markov Models and Selected Applications in Speech Recognition" by L. Rabiner et al. While the true distributions are unobtainable in principle, approximations under modelling can be determined instead. The estimation determines a local optimum but is dependent on having good initial conditions to train from. In this application the initial conditions are provided by suitable training data obtained from a dictionary.

A variety of expansions of the terms P(S|W) and P(S) can be derived, depending on the computational cost which is acceptable, and the amount of training data available. There is thus a family of models of increasing complexity which can be used in a methodical way to improve the accuracy of the syllabification process.

The function P(S) can be modelled most simply as a bi-gram distribution, where the approximation is made that:

$$P(S) = \prod_{i=1}^{m} P(S_i \mid S_{i-1}, \ldots, S_1) \approx P(S_1) \prod_{i=2}^{m} P(S_i \mid S_{i-1})$$

Such a simple model can capture many interesting effects of syllable placements adjacent to other syllables, and adjacent to boundaries. The first and second embodiments described above effectively seek to maximize P(S) using a bi-gram model. However, it would not be expected that subtle effects of syllabification due to longer range effects, if they exist, could be captured this way.

The function P(S|W) can be simply modelled as $$P(S \mid W) = P(S_1 s_2 \ldots s_n \mid w_1 w_2 \ldots w_m)$$

$$\simeq \prod_{i=1} P(s_i \mid w_j \ldots w_k)$$

which has the value zero everywhere, except when $s_i = w_j, \ldots, w_k$ for any j,k, when it has the value one i.e. each syllable is spelt the same way as the letters which compose it. As the above values are only ever zero or one there is no need to include them in the above embodiments. However, a more sophisticated model of syllabification which incorporates spelling changes at syllable boundaries can be utilized. An example of such spelling changes is given when considering the syllabification of "want to" and "wanna". In which case the function P(S W) may comprise a plurality of values other than zero and one. A further application of above might be to model inflexional or derivational morphology where spelling changes are observed at syllabic boundaries.

One complication exists before either the Viterbi decoding algorithm for determining the desired syllable sequence, or the Forward-Backward parameter estimation algorithm can be used. This is due to the combinatorial explosion of state sequences due to the fact that potential syllables may have common letter sequences and therefore overlap with one another. This leads to the decoding and training algorithms becoming $O(n^2)$ in computational complexity, as usual for this type of problem. The difficulty can be overcome by use of context-free parsing technique, such as the substring tabular layout method as shown in FIG. 4. The method will be briefly described.

Using the Cocke-Kasami-Younger parsing algorithm, these substrings can be conveniently represented as a triangular table. Where the table contains non-zero elements the index number of the unique syllable can be found. The first step in parsing the word is to generate all possible substrings and check them against a table of possible syllables. Even for long words comprising 20 or 30 letters, this is not an onerous task. If a substring is identified as a possible syllable then the unique identifying number of the syllable can be entered into the table.

The bi-gram sequence model can now be calculated by an adaptation of the familiar CKY algorithm described above. In this way it is possible to calculate all the possible syllable sequences which apply to the given word without being overwhelmed by a search for all possible syllable sequences.

The following methodology can be used to build a practical implementation of the technique outlined above:

1. Collect a list of possible syllables.
2. From the observed data of orthographic-syllabic word pairs, construct an initial estimate of $P(M)=\Pi P(m_i|m_{i-1})$. This is the bi-gram model of syllable sequences.
3. Using another list of words, not present in the initial training data, use the Forward-Backward algorithm to improve the estimates of the bi-gram model. This step is optional if the original orthographic-syllabic word pairs is sufficiently plentiful, since the hand annotated text may be superior to the maximum likelihood solution generated by the Forward-Backward algorithm.

To decode a given orthographic word into its underlying syllable sequence, first construct a table of the possible syllables in the manner given above. Use the variant of the parsing algorithm described above to obtain a value for the most likely syllable sequence which could have given rise to the observed spelling in a way consistent with the Viterbi algorithm for strict HMM's.

The above embodiments can were tested and trained by collecting a large body of words for which orthographic, syllabic and pronunciation information were available e.g a machine readable dictionary. The data was divided into training data comprising approximately 220,000 words and test data comprising approximately 5000 words. From the 220,000 words constituting the training data a set of approximately 27,000 unique syllables were identified. An initial estimate of the syllable bi-gram model was directly determined by observation. The initial model was able to decode the training data with 96% accuracy and the test data with 89% accuracy thereby indicating that either the bi-gram model was inadequate or there was insufficient training data. Therefore, a further 100,000 words, not contained in the dictionary, were obtained from a newspaper. Numeric items, formatting words and other textual items not suitable for the test were omitted. Assuming that no new syllable types were required to model the new words, the training procedure was used to adapt the initial model obtained by observation. The subsequent performance using the training data was 94% and using the test data was 92%.

The problem of syllabification is also of interest in Speech Recognition where there is a need to generate phonetic baseforms of words which are included in the recognisers' vocabulary. In this case the work required to generate a pronouncing dictionary for a large vocabulary in a new domain, including many technical terms and new jargon not previously seen, calls for an automatic, rather than manual techniques. Accordingly, the teaching of the present invention is also applicable to speech recognition.

It is to be understood that variations and modifications of the present invention may be made without departing from the scope of the invention. It is also to be understood that the scope of the invention is not to be interpreted as limited to the specific embodiment disclosed herein, but only in accordance with the appended claims when read in the light of the foregoing disclosure.

What is claimed is:

1. A method for automatic word syllabification in a speech synthesis system, comprising the steps of:

generating all possible substrings constituting part of an input text word;

assigning to each said possible substring a respective probability of being a correct syllable, based on predetermined substring frequency information; and, determining from all said possible substrings a sequence of said substrings which represents a most probable syllabification of said input text word, based on said respective assigned probabilities.

2. A method as recited in claim 1, wherein said determining step comprises the steps of:

establishing all possible sequences of said substrings constituting said input text word;

calculating for each said possible sequence a probability value indicative of a probability of occurrence of that sequence from said respective probabilities of the substrings constituting that sequence; and, selecting as said most probable sequence that one of said sequences having the highest probability value.

3. A method as recited in claim 2, wherein said calculating step comprises calculating said probability value of each said sequence as a product of said respective probabilities of said substrings constituting each said sequence.

4. A method as recited in claim 3, comprising the step of defining said respective probabilities as a probability of occurrence of said respective substrings.

5. A method as recited in claim 3, comprising the step of defining said respective probabilities as a probability of occurrence of said respective substrings given an occurrence of at least one preceding substring.

6. A method as recited in claim 3, comprising the steps of:

storing said respective probabilities in a look-up table; and, using said substrings as indices for said look-up table.

7. A method as recited in claim 1, wherein said determining step comprises:

selecting one of said substrings capable of forming a beginning of said input text word as a first substring in said sequence;

determining from all said possible contiguous substrings a contiguous substring having a highest probability value;

adding said determined contiguous substring to said sequence; and, repeating said determining and adding steps until said sequence matches said input text word.

8. A method as claimed in claim 7, wherein said selecting step comprises selecting said substring having a greatest probability of forming said beginning of said input text word.

9. A method as claimed in claim 1, further comprising the steps of:

selecting each said possible substring capable of forming a beginning of said input text word;

determining from all said possible contiguous substrings a contiguous substring having a highest respective probability value;

adding said determined contiguous substring to said sequence;

repeating said determining and adding steps until said sequence matches said input text word;

calculating for each said sequence an overall probability value; and, selecting that one of said sequences having a highest overall probability value.

10. A method as recited in claim 9, comprising the step of defining said respective probabilities as a probability of occurrence of said respective substrings.

11. A method as recited in claim 9, comprising the step of defining said respective probabilities as a probability of occurrence of said respective substrings given an occurrence of at least one preceding substring.

12. A method as recited in claim 6, comprising the steps of:

storing said respective probabilities in a look-up table; and, using said substrings as indices for said look-up table.

13. A method as recited in claim 1, comprising the step of defining said respective probabilities as a probability of occurrence of said respective substrings.

14. A method as recited in claim 1, comprising the step of defining said respective probabilities as a probability of occurrence of said respective substrings given an occurrence of at least one preceding substring.

15. A method as recited in claim 1, comprising the steps of:

storing said respective probabilities in a look-up table; and, using said substrings as indices for said look-up table.

* * * * *